United States Patent [19]

Simmons

[11] 4,128,985

[45] Dec. 12, 1978

[54] CONTROL SYSTEM FOR PACKAGE MAKING MACHINE

[75] Inventor: Charles J. Simmons, East Longmeadow, Mass.

[73] Assignee: Package Machinery Company, East Longmeadow, Mass.

[21] Appl. No.: 846,820

[22] Filed: Oct. 31, 1977

[51] Int. Cl.[2] ..... B65B 57/16; B65B 9/10

[52] U.S. Cl. ..... 53/51; 53/502; 53/64; 53/77; 53/551

[58] Field of Search ..... 53/51, 59 W, 64, 77, 53/180 M

[56] References Cited

U.S. PATENT DOCUMENTS

| | | | |
|---|---|---|---|
| 2,869,298 | 1/1959 | Zwoyer | 53/51 |
| 3,546,835 | 12/1970 | Mobley | 53/51 X |

*Primary Examiner*—Travis S. McGehee

*Attorney, Agent, or Firm*—McCormick, Paulding & Huber

[57] ABSTRACT

A package making machine of the vertical form, fill and seal type has an improved electrical control system operable on demand irrespective of the intervals of time between a train of cycle start signals and operable independently of the mechanical power source for the machine and/or its associated product feeder. The machine has a tube feeder operable during a portion of each bag making cycle and an end sealer operable during another portion of each cycle. Side sealing is accomplished during feeding by a hot belt sealer and secondary operations include a jammed product dislodging plunger, an air blast, a code dater, and a bag cut-off knife. All of the foregoing are operable by the control system in timed relationship and the system is also capable of controlling a product dump device in the product feeder. The tube feeder is controlled by an adjustable timer or by a photoregistration circuit which reads marks printed along the length of the web from which the package tube is made. When photoregistration feeding is used, the feed timer operates as an override to shut down the system on failure of one or more registration marks. The end sealer is controlled by an adjustable timer as are all secondary operations. A timed overheat device is operable to remove the hot belt sealer from the tube. Independent adjustment of all operations in their timed relationship and duration of operation is possible as well as adjustment of overall cycle time.

29 Claims, 4 Drawing Figures

CONTROL SYSTEM FOR PACKAGE MAKING MACHINE

BACKGROUND OF THE INVENTION

This invention relates to machines for making filled packages, and more particularly, to package making machines of the type wherein a tube of packaging material is sealed successively along longitudinally spaced lines extending transversely of the tube and is supplied with charges of product introduced to the tube between successive transverse sealing operations.

The improved control system of the invention is capable of general application but is shown and described, by way of example, in association with a package making machine of the type commonly referred to as a vertical form, fill and seal machine. In this type of machine, the packaging tube is made by folding a web of packaging material and sealing its overlapped side edges. Thus, side sealing as well as transverse or end sealing is required and the machine illustrated includes a continuous hot belt side sealer although the invention is not so limited. In the description and claims which follow terminology such as "package" and "bag" is used and is intended to be generally synonomous with other like terms such as "pouch," envelope," etc. Terms such as "product" and "charges of product" refer to any of a wide variety of package fill which can be accommodated in vertical form, fill and seal machines. The charges of product may be weighed and successively discharged by an associated product feeder, the feeder may provide a volumetric rather than a weight determination of product charge, and other means may be employed in introducing charges of product, this including the manual dumping of product into a tube.

As will be apparent, it is important to have the capability of varying the length of bags produced to suit the weight or volume of product to be introduced to each bag, or to correspond to the length of each repeat of indicia which may be printed on the tube. Accordingly, it has been a common expedient to provide for some bag length adjustment, but in the older machines the adjustment is difficult to make and often requires shifting or replacement of timing cams or other mechanical parts, the adjustment thus requiring that the machine be stopped or in a "down condition." Further, bag length determining mechanism has been conventionally interrelated with the sealing mechanism in such manner that adjustment of bag length disturbs timing of the sealing function and renders adjustment of the sealing mechanism necessary in order to bring the machine back to a condition of proper operation at each new bag length. When, as is common in the older machines, the tube of packaging material is fed through the machine by a reciprocating end sealer, the jaws of the sealer serve not only to form the transverse end seals but also to grip and pull the tube through the machine as the sealer moves in one direction of its reciprocating motion. Thus, the tube feeding function and the end sealing function must be performed during the same portion of each bag making cycle, and the amount of time devoted to tube feeding during each cycle cannot be shortened beyond the minimal amount of time required to produce satisfactory end seals. If, in such machines, the tube is made by folding a web of sheet material into a tube with overlapped longitudinally extending side edges and then sealing the overlapped side edges to one another by means of a longitudinal seam sealer, the longitudinal seal forming operation is commonly performed during the return stroke of the end sealer when the tube is stationary. Thus, the end seal operation and the longitudinal seal operation occur in different portions of the bag making cycle and each requires an associated minimal amount of time to effect acceptable seals. That is, each bag making cycle must include a first minimal amount of time for making satisfactory end seals and a second minimal amount of time for making satisfactory longitudinal seals, and each cycle cannot be shortened in time beyond the sum of such two minimum time periods.

In my U.S. Pat. No. 4,023,327, CONTROL SYSTEM FOR PACKAGE MAKING MACHINE, a vertical form, fill and seal packaging machine is provided with a tube feeder in the form of selectively operable feed belts and with a stationary end sealer. The control system in this patent includes a feed timer for operating the belts and has the capability of bag length adjustment merely by manual adjustment of the timer, thus adjusting that portion of the cycle devoted to the tube feeding operation. Photoregistration tube feeding termination and resulting bag length adjustment is also provided for with the feed timer serving as an override. End sealer operation occurs during the remaining portion of each cycle of operation after termination of tube feeding operation and prior to a next succeeding cycle start signal. Cycle start signals are derived from a cam driven by the mechanical power source of the machine and/or its associated product feeder.

The machine and control system of the patent provides for improved accuracy and flexibility of control but is not wholly satisfactory. Cyclical operation of the control system is tied to and derived from the mechanical power source and thus control system cycle time and machine cycle time are not independently adjustable. Neither are the various portions of the cycle of operation subject to independent adjustment. With overall cycle time mechanically determined, and with end sealing time determined as the remainder of each cycle after feeding, wholly independent adjustment of end sealing time is unavailable. Further, similar limitations are imposed on other secondary operations of the machine.

It is the general object of the present invention to provide an improved control system for a vertical form, fill and seal packaging machine, or other packaging machine of the transverse tube sealing type, the system having the capability of independent feed time, end seal time and overall cycle time adjustment.

A further object of the invention is to provide an improved on-demand control system operable in response to a series of cycle start signals irrespective of the time interval between said signals.

A still further object of the invention is to provide an improved control system for effecting various secondary operations in a packaging machine of the type mentioned, said secondary operations being adjustable as to time of occurrence and/or duration within each cycle of operation.

A still further object of the invention is to provide an improved control system of the type mentioned capable of controlling a product dump device in a product feeder associated with the packaging machine, the timed occurrence of dumping within each cycle of operation being manually electrically adjustable.

A still further object of the invention resides in the provision of a control system of the type set forth wherein manual electrical adjustment of all the aforesaid functions is possible during operation of a packaging machine and its product feeder.

Other objects and advantages of the invention will be apparent from the drawings forming a part hereof and from the following detailed description and claims.

SUMMARY OF THE INVENTION

The invention resides in a machine for making filled packages from a tube of packaging material by successively feeding charges of product to the tube and sealing the tube between product charges along transversely extending seal lines at spaced points along its length, the machine having an improved electrical control system whereby the primary operations of tube feeding and end sealing during each bag making cycle may be controlled and varied by adjustment of electrical manually operable means. More particularly, the invention resides in the control system including a means for generating a bag making cycle start signal and a tube feed signal in consequence of the cycle start signal. A stop feed signal is generated by an adjustable feed timer or by photoregistration circuitry and a seal signal is generated by the control circuitry in response to the stop feed signal. An end seal timer operates to control the sealing function and generates a stop seal signal for completion of a cycle of operation. Provision is also made for manual adjustment of the duration of the seal signal. Timers also control various secondary machine operations and are adapted for manual adjustment. Cycle time is thus adjustable relative to frequency of cycle start signals and is normally established to insure cycle completion prior to the next succeeding cycle start signal. Thus, when necessary in high speed machine operation, a delay is provided between cycle completion and the next cycle start signal to assure that the end sealer is moved free of the tube before a succeeding tube feed operation is initiated. The control system also includes means for preventing a cycle start operation in the event that a cycle start signal is received prior to the completion of a cycle of operation.

The feed timer and photoregistration circuitry are selectively operable but the feed timer also has an override function when the photoregistration circuitry is energized. In the event that a photoregistration mark does not appear or the photoregistration circuit does not respond and the cycle does not proceed to completion with its end sealing function then the timer on failure of a second photoregistration mark or response will operate as an override device to disable the control system and to terminate operation of the primary and secondary operating devices under its control.

DETAILED DESCRIPTION OF THE PREFERRED EMBODIMENT

Figure 1:
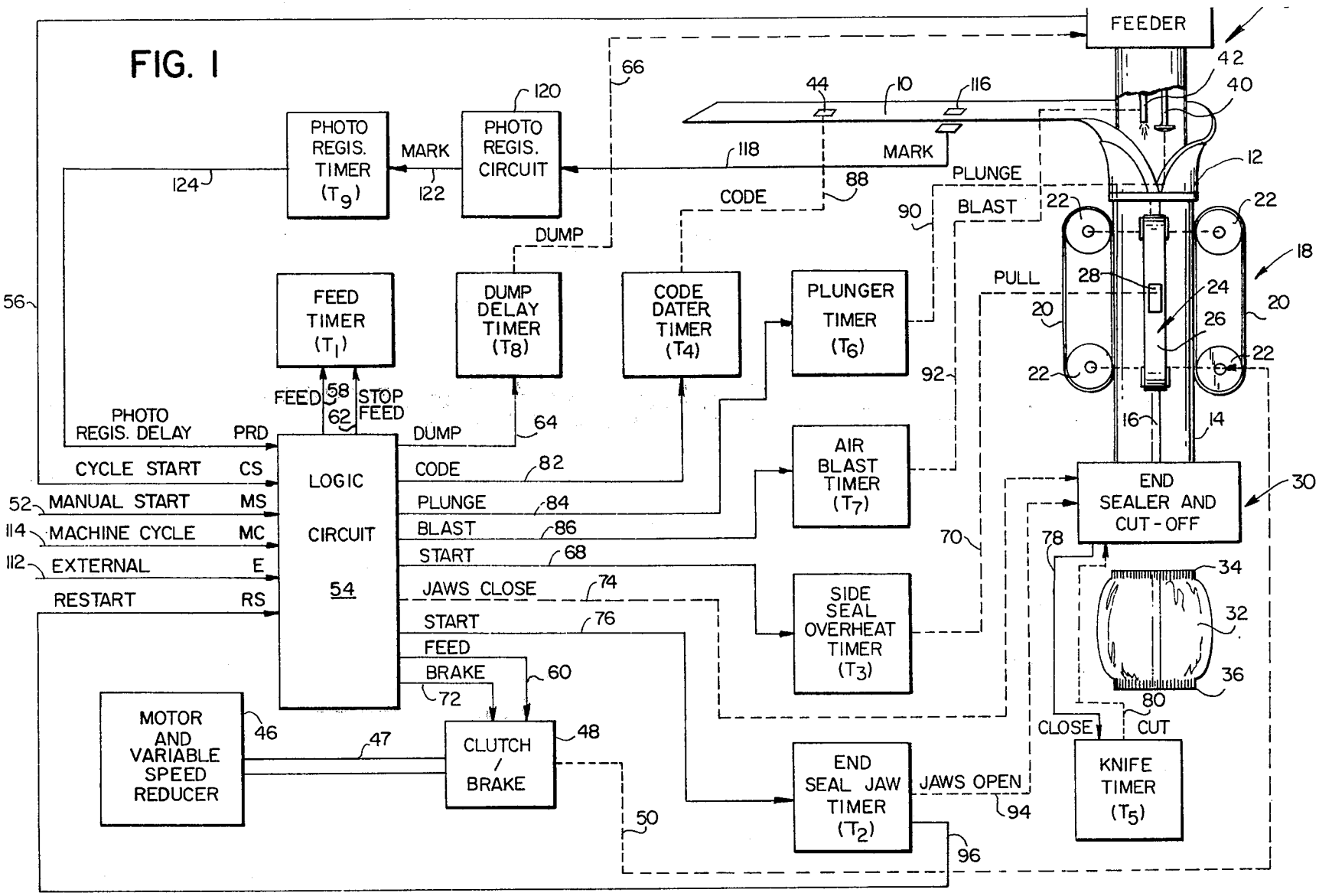
FIG. 1 is a schematic drawing illustrating a vertical form, fill and seal package making machine and an associated improved control system embodying the present invention.

Referring particularly to FIG. 1 it will be observed that the improved control system of the present invention is there illustrated schematically in association with a packaging machine of the vertical form, fill and seal type. In the machine shown, a continuous web 10 of heat sealable packaging material is supplied from a roll or other source (not shown) and is guided to a folder 12 which progressively forms the web into a downwardly extending tube 14 having overlapped longitudinal side edges indicated at 16. The tube 14 is drawn through the folder 12 by a tube feeder indicated generally at 18 and which comprises a pair of intermittently operable feed belts 20, 20 arranged with inner runs extending vertically and engaging opposite sides of the tube 14. Each belt 20 has an associated pair of vertically spaced rolls 22, 22 with lower rolls 22, 22 indicated as power driven. For purposes of the present invention, the feeder 18 may be regarded as being either of the friction or vacuum type. In the latter instance, the belts 20, 20 would of course be perforate and backed by a vacuum chamber so as to attract the tube to the inner runs of the belt and thereby to increase the grip between the tube and belts. The detailed construction of the tube feeder is not, however, an essential part of the invention and various other types of feeders may be employed without departing from the spirit of the invention.

Disposed beneath the folder 12 and between the belts 20, 20 of the tube feeder 18 is a longitudinal or side seam sealer indicated generally at 24. The longitudinal seam sealer 24 operates to heat seal the overlapped side edges 16 of the tube to one another and may vary widely in form. As shown, the sealer 24 is of the hot belt type and comprises a belt trained over upper and lower rolls and backed by a heater element 26 and with an inner belt run in engagement with the overlapped side edges 16 of the tube. A vertical back-up bar (not shown) depends within the tube to react the force of the belt sealer 24. The upper and lower rolls of the side sealer 24 may be connected with and driven from the tube feeder 18 or may be driven independently. In either event, the side sealer 24 and the tube feeder 18 operate in unison and may be conveniently driven from the same mechanical power source in the packaging machine.

With the side sealer belt 24 in continuous engagement with the tube 14 sealing of successive tube sections or bag lengths occurs in normal running operation of the packaging machine. When tube feeding operation of the machine is stopped, however, overheating of the adjacent portion of the tube side edges may occur and may result in degradation or destruction of the packaging material. Accordingly, a selectively operable overheat device 28 is preferably provided and is adapted for electrical operation and control. The device may include a solenoid or other electrically operable means and serves to move the side sealer away from the tube of packaging material on receipt of an electrical signal indicating an overheating condition or the potential for overheating.

Below the tube feeder 18 and the longitudinal side sealer 28 is a transverse or end sealer and cut-off device indicated generally at 30. The sealer 30 operates to flatten the tube 14 along a zone extending transversely of the tube and to heat seal the two opposite flattened sides of the tube to one another along such zone whereby to form the top and bottom end seals of packages. One such package is indicated at 32, its upper end sealed at 34 and its lower end sealed at 36.

The end sealer 30 may take various forms and may be one of a well-known type which during each operating cycle forms the top end seal of one package and the bottom end seal of the next package and cuts the tube between the two seals whereby to separate the lowermost or terminal package from the remainder of the tube. For example, the sealer 30 may consist of two jaws disposed on opposite sides of the tube 14 and movable by electrically operable means between closed and open positions relative to one another. In the closed or operative condition of the jaws, the jaws may also serve to sever the tube as for example by means of horizontal electrical impulse or ribbon heaters. That is, the jaws or one of the jaws may carry three horizontal electrical impulse or ribbon heaters arranged parallel to one another and extending transversely of the tube. In operation, the jaws are first moved from an open or inoperative condition toward one another to flatten the tube and subsequently the three heaters are electrically impulsed, the heat generated by two of the heaters serving to form the two spaced end seals and the heat from the third heater, positioned between the other two heaters, serving to sever the tube. In a subsequent open or inoperative condition of the sealer, the two jaws are moved away from one another to release the tube and the completed package and to allow the former to be moved by the feeder 18 relative to the sealer to bring a new seal zone into alignment therewith.

When a mechanical knife cut off is desired, the intermediate heater wire may be eliminated and replaced by a selectively operable knife having electrically responsive operating means such as a solenoid. In this arrangement, the jaws are moved together, the sealing heaters are energized and the knife is then operated in properly timed relationship to sever a terminal bag such as the bag 32. It should be noted that knife operation should occur on closing of the jaws and for a timed interval thereafter.

At an upper end of the machine a product feeder is provided and is indicated generally by the reference numeral 38. The product feeder 38 dumps charges of product successively into the tube 14 through its open upper end. The charges of product are delivered between successive operations of the end sealer 30 so that the resultant packages produced by the machine are each filled with a charge of product.

Various well-known types of product feeders are available for operation on weight, volumetric, or other principles and the improved control system of the present invention is equally adaptable for use with any of the various types of feeders. The control system as shown effects cyclical operation of the packaging machine in response to cycle start signals from the feeder 38 but is not dependent on precise or regular cyclical operation of an associated product feeder and is equally receptive to cycle start signals at regularly or irregularly spaced intervals of time. Further, the improved control system and the packaging machine illustrated are capable of operation at higher rates of speed than product feeders now available. Thus, the control system can be adjusted to effect cyclic machine operation in such manner that each machine cycle is completed prior to the completion of a feeder cycle and the control system and machine thereafter merely await in a condition of readiness the next succeeding cycle start signal from the product feeder.

The product feeder 38 illustrated may be assumed to be of the product weighing type and which includes at least one scale, and usually a plurality of scales, for receiving and weighing charges of product. Such feeders also conventionally have a "scale ready" condition when a charge of product has been received, weighed and is in a state of readiness for discharge or dumping to the packaging machine. Accordingly, the improved control system and packaging machine of the present invention may be conveniently adapted to receive cycle start signals in the form of "scale ready" signals from the feeder 38. Further, feeders such as the feeder 38 illustrated commonly include an electrically operable dump device for discharging product held by a scale in a scale ready condition. That is, a solenoid or other electrically operable device may be employed to effect feeder "dump" operation subsequent to a "scale ready" condition of the feeder. The control system of the present invention includes means for operating such a dump device in properly timed relationship with related feeder and machine operations. One example of a product feeder of the type mentioned is an Eagle Scale, CN series, equipped with a series 2000 Controller, manufactured by Eagle Scale Division, Package Machinery Company, East Longmeadow, Mass.

Additional secondary operations may include a reciprocable plunger operation for dislodging jammed charges of product dumped from the feeder 38 to the tube 14. Such plunger operation may be particularly desirable with lightweight charges of product such as potato chips. A plunger 40 is illustrated schematically and may be assumed to have electrically operable intermittently reciprocable means such as a solenoid or the like (not shown). The improved control system of the invention is adapted to control and to properly time such plunger operation.

It is also desirable with certain product charges to provide for an air blast and an air nozzle is schematically illustrated at 42. Electrically operable means (not shown) control the intermittent downward discharge of air from the nozzle 42 and may be adapted to provide a continuous blast of air or a plusating blast as required. The control system of the invention includes means for controlling and properly timing such air blast operation.

Indicia may be conveniently pre-printed on the web 10 from which the packaging tube 14 is formed. As illustrated, a device for imprinting the web 10 or a "code dater" 44 is provided and is electrically operable under the control of the improved control system of the invention.

A mechanical power source for the packaging machine, and alternatively for both the machine and the product feeder 38, includes a drive motor and variable speed reducer 46, the reducer being of a conventional type which is manually or otherwise adjustable to vary speed ratio between its input and output. The output drive member of the reducer 46 is drivingly connected to the tube feeder 18 by a power transmitting train including shaft or line 47 clutch brake 48 and broken line 50 extending to the drive tube feeder rolls 22, 22. The hot belt sealer 24 is also driven from the clutch brake 48 and operates in unison with the feed belts 20, 20 of the tube feeder as indicated above. Clutch brake 48 includes both a clutch for making and breaking the driving connection between the motor and speed reducer 46 and the feeder 18 and sealer 24 as well as a brake for braking the motion of the feeder and sealer. The mechanism 48 has a drive mode and a brake mode. In its drive mode, the clutch portion of the mechanism is energized and engaged to drivingly connect the tube feeder and sealer to the speed reducer 46 and the brake portion is de-energized or released. In the brake mode, the clutch portion is disengaged to break the driving connection between the speed reducer and the feeder and sealer and the brake is engaged to stop and hold the tube feeder and sealer against inadvertent movement. The clutch-brake 48 is electrically operable as by solenoid and requires feed and brake signals in controlling the operation of the tube feeder 18 and side sealer 24.

With the motor and variable speed reducer 46 operating and with the feeder 38 powered thereby or by independent means, operation of the improved control system may be initiated by a manual start signal (MS) line 52. The feeder 38 will thereafter emit a time-spaced train of cycle start (CS) signals and as indicated above such signals may take the form of "scale ready" signals. Ordinarily, the time-spaced train of CS signals will comprise a series of equally spaced signals but unequally spaced or irregular CS signals may occur as for example when a scale loading mechanism in the feeder malfunctions or operates to delay such signals in response to difficulties encountered in handling or loading products to the scale. As mentioned, the control system accommodates such unequally spaced CS signals as well as equally spaced signals operating to initiate and complete a machine cycle and then to await a delayed CS signal in a state of readiness and also operating to prevent a premature machine cycle in the event that a CS signal somehow appears prior to completion of a machine cycle.

The CS signals are supplied to logic circuit 54 from the feeder 38 via line 56. With logic circuit 54 preset for feed timer operation, the appearance of each CS signal triggers feed timer $T_1$ via line 58, FIGS. 1 and 2. Simultaneously, logic circuit 54 transmits a feed signal through line 60 to clutch brake 48, the latter in turn assuming its drive or feed mode for operation of the tube feeder 18 and the side sealer 24. Tube feeding and side sealing operation then continues while timer $T_1$ times out and prior to the emission of a stop-feed signal from the timer. Line 62 carries the stop-feed signal to the logic circuit 54.

Figure 2:
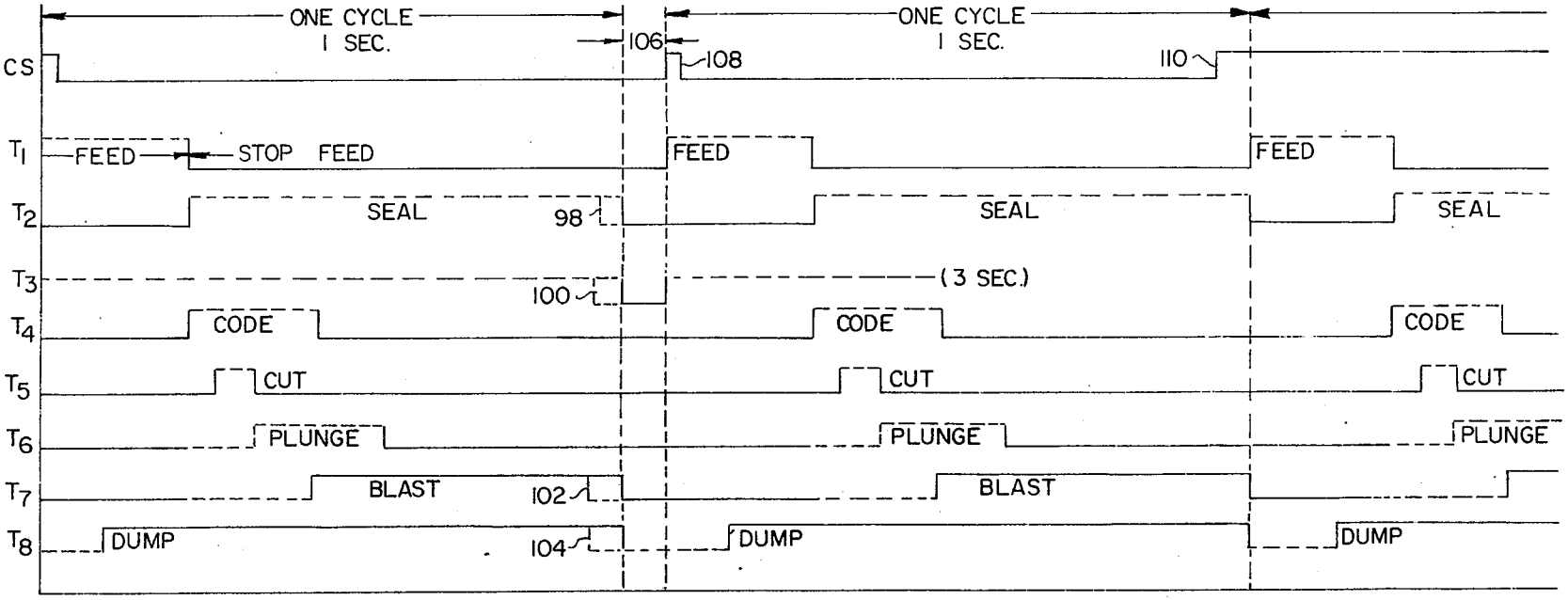
FIG. 2 is a timing diagram illustrating the nature and duration of various signals appearing in various places in the control system during each bag making cycle of the FIG. 1 apparatus, the control system having been pre-set for feed timer operation.

Prior to timer $T_1$ timing out, and as illustrated in the diagram of FIG. 2 at the commencement of feed, logic circuit 54 also transmits a "dump" signal to dump delay timer $T_8$ via line 64. Dump delay timer $T_8$ in turn transmits a dump signal to feeder 38 via line 66 but only after a preselected time delay as indicated by the $T_8$ broken line in FIG. 2. The time delay is adjustable as indicated above and permits precise timing of the dump operation of the feeder in relation to feeding, sealing and other operations of the packaging machine. As illustrated, the dump operation ordinarily occurs at an intermediate point during the feeding operation as indicated in FIG. 2.

Side seal overheat timer $T_3$ is also started by logic circuit 54 on receipt of each CS signal by the latter. A "start" signal is transmitted from logic circuit 54 through line 68 to timer $T_3$ and the timer continues operation to the end of a machine cycle when it is reset on completion of an operative cycle again through line 68. In the event that the machine cycle is non-feeding, non-sealing or otherwise inoperative, resetting of the timer $T_3$ does not occur and it continues to time through a second and perhaps a third inoperative cycle of machine operation. As indicated above, the timer may be pre-set to time out after a preselected interval of time such as three seconds shown in FIG. 2. Noting that one second cycles of machine operation are contemplated in FIG. 2, the timer will thus operate after two successive inoperative machine cycles and during the third inoperative cycle to transmit a signal through line 70 to "pull" the side sealer 24 to an inoperative position away from the tube of packaging material 14, thus serving to prevent overheating, degradation and possible destruction of the tube.

When the required feeding and side sealing time has elapsed, and when the stop-feed signal is received by logic circuit 54 from the timer $T_1$ via line 62, the circuit 54 operates to reverse the modes of clutch brake 48 via line 72. That is, the clutch is de-energized and the brake energized to stop the feeding operation of tube feeder 18 and to terminate the sealing operation of side sealer 24. The tube of packaging material 14 is now ready for end sealing and logic circuit 54 transmits a "seal" or "jaws close" signal to the sealer through line 74. The sealer jaws close and end sealing operation commences and end seal jaw timer $T_2$ is simultaneously energized through line 76. Knife timer $T_5$ is also energized at this time by jaw closing action through line 78 from the end sealer and cut off device 30 and thereafter effects a bag cut-off operation transmitting a "cut" signal to the cut-off device through line 80, FIGS. 1 and 2.

"Code," "plunge," and "blast" signals are also emitted by logic circuit 54 in response to a stop-feed signal. Code dater timer $T_4$ is triggered through line 82, plunger timer $T_6$ through line 84, and air blast timer $T_7$ through line 86. Code dater timer $T_4$ in turn energizes electrically operable code dater 44 through line 88 and maintains operation thereof for a preselected period of time as indicated in FIG. 2. Plunger timer $T_6$ operates first to delay the plunge operation and thereafter to determine the duration thereof as illustrated in FIG. 2, line 90 interconnecting plunger timer $T_6$ and plunger 40. Air blast timer $T_7$ operates in a similar manner and may first delay air blast operation and thereafter provide a continuous air blast as indicated in FIG. 2. Alternatively, timer $T_7$ or the operating means for the nozzle 42 may provide a pulsating air blast as mentioned above. The timer $T_7$ is connected with the air blast device 42 by operating line 92.

When end seal jaw timer $T_2$ times out, the machine cycle is effectively complete and the timer transmits a "stop seal" or "jaw open" signal to the end sealer 30 through line 94. The jaws withdraw from the tube of packaging material 14 and a filled bag such as 32 is completed and gravity discharged. Simultaneously with transmission of a jaw open signal through line 94, the timer $T_2$ transmits a restart (RS) signal through line 96 to logic circuit 54. Logic circuit 54 is thereby conditioned for a next succeeding CS signal and cycle of machine operation. Timer $T_3$ and various other timers are reset as required and the control system resides in a state of readiness for a CS signal as illustrated in FIG. 2.

Broken lines 98, 100, 102 and 104 in FIG. 2 illustrate the manner in which the timer $T_2$ may be adjusted to adjust sealing time and to adjust overall machine cycle time. Timer $T_1$ may of course be similarly adjusted. As indicated above, the type of packaging machine illustrated is normally capable of faster operation than the product feeder. Accordingly, a gap 106 is illustrated in FIG. 2 between machine cycles. The gap may of course vary with various packaging machine and feeder combinations and may be conveniently adjusted to assure sufficient time for end sealer jaw opening operation.

On the occurrence of a second scale ready or CS signal indicated by pulse 108 in FIG. 2, logic circuit 54 and the control system of the invention effects a second or next succeeding cycle of machine operation as illustrated in FIG. 2. Such operation may be in all respects identical with the above described first cycle of operation.

The third cycle of machine operation partially illustrated in FIG. 2 responds to a cycle start signal 110 which occurs at a premature instant in time. The signal may be regarded as a continuous or longer term pulse in contrast with the preceding short-pulse CS signals. As indicated above, the control system will not react to a premature signal such as 110 due to the absence of a restart signal RS from the end seal jaw timer $T_2$ through line 86. Instead, the control system will complete the then running cycle of machine operation and when the RS signal is received by logic circuit 54 the next succeeding or third cycle of operation will be initiated as illustrated.

Operation of the control system of the present invention in response to an external signal (E) through line 112 may be identical with the operation described above. Such an external signal may, for example, derive from a manual depress button operated by an individual manually filling bags and who would of course provide intermittent signals E but such signals would comprise an unequally time-spaced train of E signals. As stated the control system accommodates such a train of signals and effects machine cycles accordingly.

Logic circuit 54 and improved control system may also be operated by a machine cycle signal (MC) through line 114. As will be more fully explained hereinbelow, the control system effects a single cycle of operation in response to such a signal and such a cycle may be conveniently employed in machine set-up operations. In this regard, it should also be noted that all timers and resulting machine operations are capable of manual adjustment with the machine operating.

Figure 3:
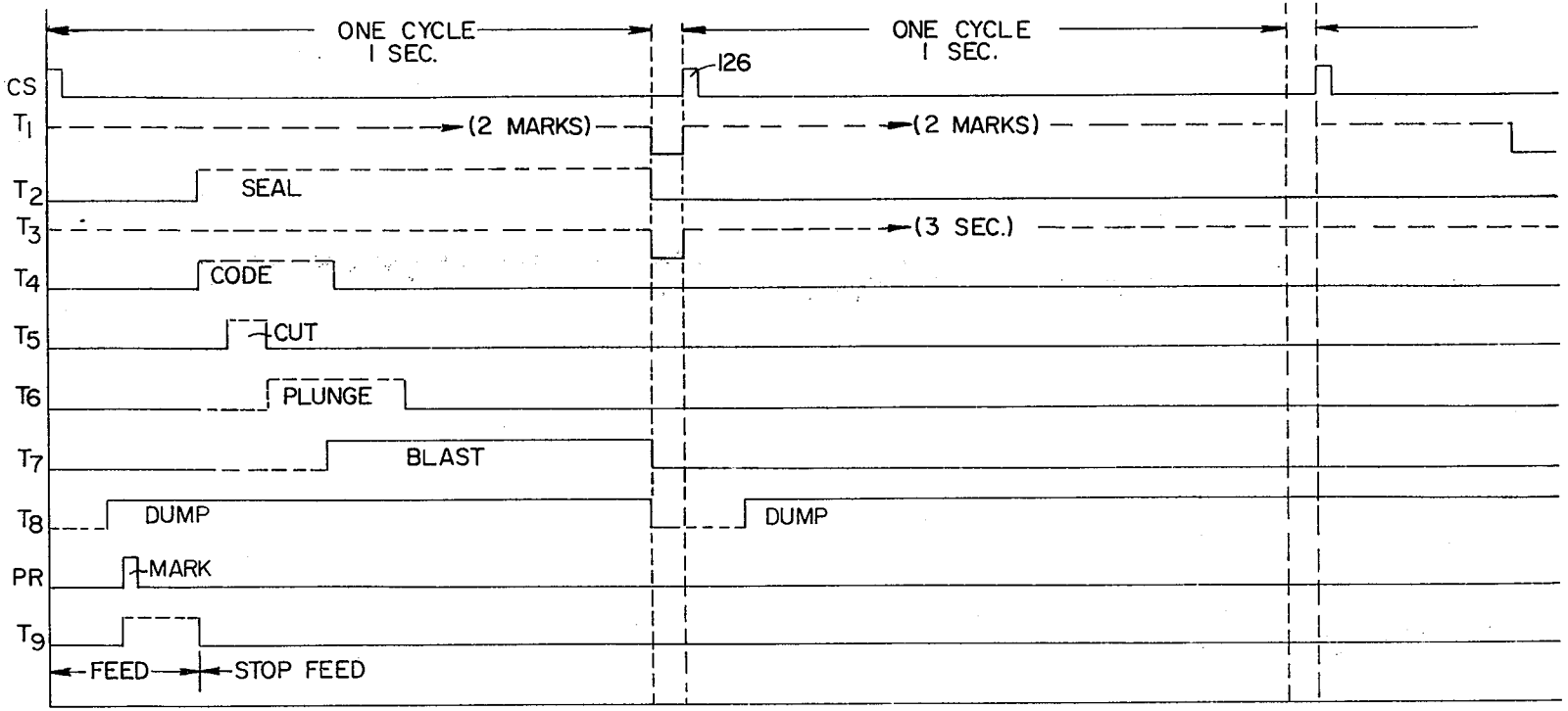
FIG. 3 is a timing diagram similar to FIG. 2 but showing the nature of signals appearing at various places in the control system of the machine in FIG. 1 during each bag making cycle, the photoregistration bag length determining circuitry having been preselected.

FIG. 3 illustrates operation of the improved control system and packaging machine with logic circuit 54 set for photoregistration operation and with feed timer $T_1$ serving an override function. In this mode of operation, a CS signal triggers timer $T_1$ adjusted to run for a substantially longer period of time illustrated as "two marks" in FIG. 3. Clutch-brake 48 is operated to initiate feeding and side sealing operation and the dump operation occurs during feeding as in timer controlled operation. That is, logic circuit 54 immediately triggers feed timer $T_1$ for its override operation and simultaneously energizes clutch-brake 48 for a drive or feed mode of operation through line 60. On the subsequent passage of a registration mark on the web 10 through a photodetector 116 a signal is transmitted through line 118 to photoregistration circuit 120 and thence to photoregistration timer $T_9$ through line 122. Photoregistration timer $T_9$ thereupon times out and transmits a photoregistration delay signal (PRD) through line 124 to the logic circuit 54. The PRD signal to the logic circuit 54 is equivalent to the stop feed signal of timer line 62 mentioned above. Thus, the logic circuit 54 operates to transmit a brake signal through line 72 to the clutch-brake 48 and to terminate feeding and side sealing operation. A jaw close signal through line 74 simultaneously effects operation of end seal and cut-off device 30 and the various secondary operations are effected and controlled as described above. The cycle is completed when the end seal jaw timer $T_2$ times out and the system receives an RS signal and resides in readiness for a second CS signal 126. At this point it should be noted that precise timing and operation of tube feeding in relation to other machine operations is provided for in the manual adjustability of photoregistration timer $T_9$.

Assume now in the second cycle in FIG. 3 that a photoregistration mark does not appear on the web 110. Failure of the mark will result in failure of a PRD on stop-feed signal from the photoregistration timer $T_9$ through line 124 and the control system will cause the machine to complete an inoperative cycle. That is, feeding of the tube and side sealing thereof will continue and the end sealer and cut-off device 30 will fail to operate. A second successive failure of a photoregistration mark as in the third cycle of operation partially shown in FIG. 3 will result in feed timer $T_1$ timing out as indicated. This will result in transmission of a disable signal through line 62 to the logic circuit 54 and the latter will operate to disable itself and to disable the machine for further operation. The timer $T_1$ may of course be set for such disabling operation on the occurrence of one, two or more mark failures on the web 10.

Figure 4:
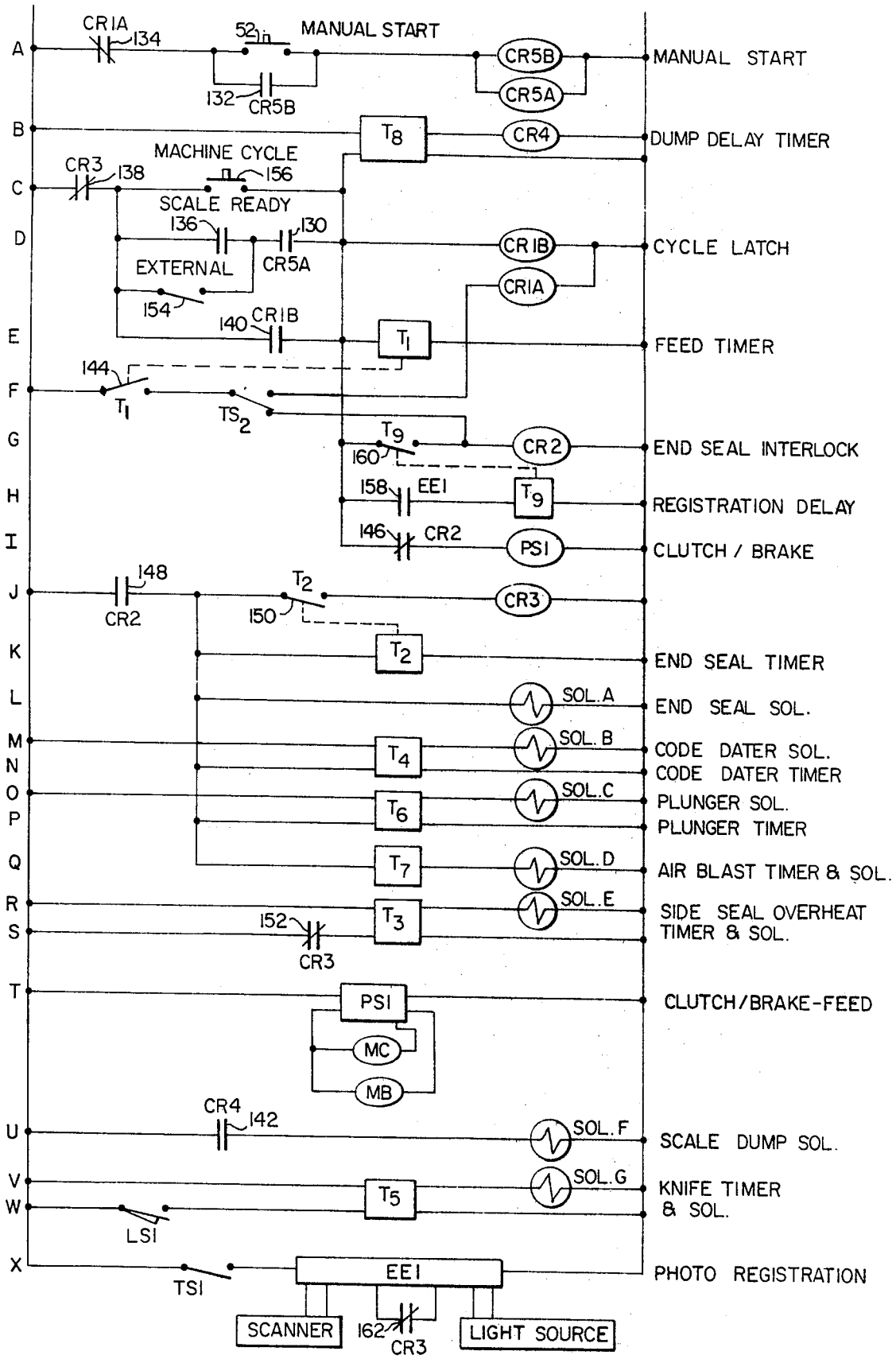
FIG. 4 is a schematic wiring diagram or the improved control system of the present invention.

Referring now particularly to FIG. 4, the logic and other circuitry of the control system of the present invention will be described in greater detail. Control relays and other elements shown may of course be replaced by solid state devices and various forms of the control circuitry may be employed without departing from the scope of the invention. The system illustrated has electrical leads $L_1$ and $L_2$ extending through lines A through X.

Depression of MS or manual start button 52 in line A results in energization of control relays CR5A and CR5B and in closing of associated CR5A relay contacts 130 in line D and CR5B contacts 132 in line A. Contacts 132 latch in or hold relays CR5A and CR5B through normally closed relay contact CR1A at 134 in line A.

With CR5A and CR5B latched in through contacts 132 and with contacts 130 closed, the circuit is ready for reception of a CS or scale ready signal at contacts 136, CR3 contacts at 138 in line C being normally closed. On receipt of a CS or scale ready signal at 136 in line D, control relay CR1B is energized and its contacts 140 in line E are closed. Thus, relay CR1B is latched in or held, and timers $T_1$ and $T_8$ in lines E, B are energized. Timer $T_8$ times out, energizes control relay CR4 in line B, closes its normally open contacts 142 in line U and thus energizes solenoid F for scale dump operation. In the interim, normally closed contacts 146 of relay CR2 in line I energize power supply I (PSI) for clutch-brake operation and for a tube feeding and side sealing operation. PS1 in line T thus energizes magnetic clutch (MC) and de-energizes magnetic brake (MB).

With manually operable toggle switch TS2 in line F in the down position as illustrated in FIG. 4, timer $T_1$ times out to provide a feed stop signal and closes timer contact 144 in line F energizing control relay CR2 in line G thus opening its normally closed contacts 146 in line I and closing its normally open contacts 148 in line J. Thus, magnetic clutch MC in line T is de-energized through PSI and magnetic brake MB is energized terminating tube feeding and side sealing operations. CR2 relay contacts 148 in line J also energize solenoid A in line L for closing the sealer jaws whereupon limits switch LS1 in line W is closed by jaw closing operation to energize timer $T_5$. Timer $T_5$ times out and operates solenoid G in line V to operate the cut-off knife as aforesaid. Closing of CR2 contacts 148 in line J also energizes end seal timer $T_2$ in line K, code dater timer $T_4$ in line N, plunger timer $T_6$ in line P and air blast timer $T_7$ in line Q. The said timers thereafter time out controlling primary end sealing operation and the secondary code dating, plunging and air blasting operations as aforesaid through solenoids B, C and D.

When end seal timer $T_2$ times out, timer switch 150 in line J is closed to energize control relay CR3 and in turn open normally closed relay contacts 138 in line C, and open normally closed CR3 contacts 152 in line S. CR3 contacts 138 in line C in their open condition de-energize control relay CR1B in line D opening its contacts 140 in line E, de-energize timer $T_8$ in line B, timer $T_1$ in line E, opening timer switch T, at 144 in line F and de-energizing relay CR2 in line G. With CR2 de-energized in line G its contacts 148 in line J open to de-energize timers $T_2$, $T_4$, $T_6$ and $T_7$ and to de-energize control relay CR3 in line J. On de-energization of CR3, its contacts 138 in line C are again closed thus placing the system in a condition of readiness for a succeeding CS or scale ready signal at the contacts 136 in line D. CR3 contacts 152 in line S are also closed restarting overheat timer $T_3$.

At this point the cooperation of control relays CR2 and CR3 should be noted. In the event that a premature CS or scale ready signal appears at the contacts 136, the circuit will not respond until CR3 is energized by an RS signal occurring on the timing out of timer $T_2$. When this occurs the instantaneous opening and closing of CR3 contacts 138 in line C will reset the circuit and a second cycle of operation will commence.

Operation of the control system and machine in response to an external or E signal at manual switch 154 is or may be identical with that described above for a CS or scale ready timed feed operation. Single cycle operation of the machine is provided by manual switch 156 in line C and may also be identical with that described and such operation will terminate at the end of the first complete cycle in the absence of a second depression of the switch 156.

When it is desired that the control system and machine operate in a photoregistration rather than a timed feed mode, the toggle switch TS2 in line F is moved from the down position shown in FIG. 4 to an up position and the toggle switch TS1 in line X is moved from the open position shown to an upward or closed position. Operation then commences as described above on actuation of manual start button 52 in line A and on receipt of a CS scale ready signal at contacts 136 in line D. When the CS or scale ready signal is received, the timer $T_8$ is energized, control relay CR1B is energized to provide a latching or hold function through contacts 140 in line E, and timer $T_1$ is energized through line E but the timer is set for a substantially longer interval of time in accordance with its override function as described above. PSI in line I is energized through normally closed CR2 contacts 146 to energize magnetic clutch MC in line T and to de-energize magnetic clutch MB and to thus commence feeding and sealing operation. On occurrence of a registration mark on the web 10 as sensed by electric eye one (EE1) in line X, its contacts 158 in line H are closed to energize registration delay timer $T_9$. Timer $T_9$, after a timed interval closes its switch $T_9$ at 160 in line G thus energizing control relay CR2 whereupon the sealing and secondary functions proceed as described above. On completion of sealing and when timer $T_2$ times out, its contacts 150 in line J are closed energizing relay CR3 in line J and the cycle of operation is terminated as before. Here it should be noted, however, that relay CR3 resets timer $T_3$ through its contacts 152 in line S and may also serve to reset the photoregistration circuitry through its contacts 162 in line X. In its instantaneous opening and closing operation control relay CR3 also serves to de-energize and to reset override timer $T_1$ through operation of its normally closed contacts 138 in line C.

On failure of a registration mark on the web 10 and on resulting failure in operation of EE1, control relays CR2 and CR3 reset of the timer $T_2$ will not occur. Accordingly, after one or more cycles as determined by the setting of timer $T_1$, the timer contacts 144 in line F will close and with toggle switch TS2 in the up position as indicated, control relay CR1A in line D will be energized. Energization of control relay CR1A will result in opening of its contacts 134 in line A and the latching or holding circuit through relay contacts CR5B at 132 and relays CR5A and CR5B will be lost resulting in de-energization of relays CR5A and CR5B. This in turn will result in opening of relay contacts CR5A at 130 in line D and a subsequent CS or scale ready signal at contacts 136 will have no effect. Thus, the control system and packaging machine will be disabled and further inoperative cycling of the machine will be prevented. On completion of troubleshooting and when the machine is ready for further operation, manual start button 52 may again be depressed to reinstate the latching or holding circuit through CR5B contacts at 132 and on subsequent receipt of a scale ready signal at 136 in line D, cyclic operation of the control system and the machine will resume.

As in the former case of timed feed and sealing operation, all main and secondary operations may be adjusted by manual adjustment of appropriate timers during photoregistration operation. Further, machine speed may be adjusted at the motor and variable speed reducer 46 and the various machine operations adjusted as required in accordance therewith. All of the foregoing may be accomplished with the machine and feeder operating thus providing a high degree of flexibility in setup operations and in the subsequent operation of the packaging machine and feeder.

I claim:

1. In a machine for making packages by transversely sealing a tube of packaging material at spaced lines along its length, the combination comprising means providing a tube of packaging material, an end sealer with operative and inoperative conditions for flattening, during the former condition, said tube along a zone extending transversely thereof and for sealing opposite flattened sides to one another along said zone, a tube feeder for moving said tube longitudinally of itself past said end sealer, said feeder having powered and non-powered modes for feeding, during the former mode, said tube from alignment of one transverse seal zone with said end sealer to alignment of the next such transverse seal zone with the end sealer, means for producing time spaced bag making cycle start signals, on demand control circuitry operable in response to each appearance of a cycle start signal irrespective of the time interval between signals to generate a feed signal and a delayed stop feed signal, said control circuitry responsive to said feed signal for controlling the operation of said tube feeder so that at the start of said feed signal said feeder is shifted from its non-powered to its powered mode and on receipt of said stop feed signal said feeder is shifted from its powered to its non-powered mode, said control circuitry also being operable responsive to said stop feed signal to generate a seal signal, and said control circuitry also including an end seal timer operable responsive to said stop feed signal to generate a delayed stop seal signal and having manually operable means for selectively varying the duration of the delay in said stop seal signal, said end sealer thus being shifted from its inoperative condition to its operative condition on receipt of said seal signal and subsequently back to its inoperative condition on receipt of said stop seal signal.

2. The combination in a packaging machine as set forth in claim 1 wherein said tube feeder comprises at least one movable tube driving element engageable with an external surface of said tube.

3. The combination in a packaging machine as set forth in claim 2 wherein two tube driving elements are provided and take the form of drive belts each disposed about a pair of rollers spaced from one another along the length of the path of tube movement, one run of each belt extending parallel to said path of tube movement and drivingly engageable with the tube to feed the tube during the powered mode of the tube feeder.

4. The combination in a packaging machine as set forth in claim 1 wherein said means for providing a tube of packaging material includes means providing an elongated web of such material, a folder for folding said web of material into a tube with overlapped side edges, and a longitudinal seam sealer for sealing said overlapped side edges of said tube to one another.

5. The combination in a packaging machine as set forth in claim 4 wherein said longitudinal seam sealer comprises a heated sealing belt trained over a pair of rollers spaced from one another along the path of tube movement with one run of said belt engaging the said overlapped side edges of the tube, said belt being connected with and driven in unison with said tube feeder during the powered mode of the latter whereby simultaneously to feed and to longitudinally seal the tube.

6. The combination in a packaging machine as set forth in claim 1 wherein a product feeder is provided and is continuously driven through repeated cycles of operation for successively feeding charges of product into said tube, and wherein said means for producing a bag making cycle start signal includes means for producing one such signal during each cycle of operation of said product feeder.

7. The combination in a packaging machine as set forth in claim 6 wherein said product feeder includes at least one scale for weighing charges of product, and wherein said cycle start signals are derived from said scale and take the form of scale ready signals indicating that a charge of product has been received in said scale.

8. The combination in a packaging machine as set forth in claim 7 wherein said product feeder includes an electrically operable dump device for dumping a charge of product from said scale, and wherein said control circuitry is operable in response to each appearance of a scale ready signal to generate an operation signal for said dump device.

9. The combination in a packaging machine as set forth in claim 8 wherein said control circuitry includes a dump delay timer arranged to receive, delay and transmit said dump operation signal, said timer being adapted for manual adjustment of the duration of delay in transmitting said dump signal.

10. The combination in a packaging machine as set forth in claim 1 wherein said machine includes a drive motor having an output connected with a variable speed reducer, and wherein a power transmitting train connected with said reducer output extends to and operates said tube feeder.

11. The combination in a packaging machine as set forth in claim 10 wherein a clutch is provided in said power transmitting train and is selectively operable in either an engaged mode in which it drivingly connects said speed reducer output to said tube feeder or in a disengaged mode in which it drivingly disconnects said output from said tube feeder, said engaged mode of said clutch corresponding to said powered mode of said tube feeder and said disengaged mode of said clutch corresponding to said non-powered mode of said tube feeder, and said control circuitry being connected with said clutch and operable to shift said clutch between said engaged and disengaged modes respectively on receipt of said feed and stop feed signals to effect said powered and non-powered modes of said tube feeder.

12. The combination in a packaging machine as set forth in claim 11 and including a brake associated with said clutch and control circuitry, said brake being operable by said control circuitry when said clutch is disengaged to brake said tube feeder and being operable by said control circuitry when said clutch is engaged to release said tube feeder.

13. The combination in a packaging machine as set forth in claim 10 wherein said control circuitry is operable to commence a cycle of operation on receipt of a cycle start signal, said cycle including feed and seal operations as aforesaid, and operable to terminate said cycle of operation independently of said drive motor and variable speed reducer.

14. The combination in a packaging machine as set forth in claim 1 wherein said means for providing a tube of packaging material comprises a means providing a web of such material, a folder for folding said web of material into a tube with overlapped side edges, and a longitudinal seam sealer for sealing said overlapped side edges of said tube to one another, wherein said web of packaging material is provided with registration marks occurring thereon at regularly spaced intervals along its length, and wherein said control circuitry includes a photoregistration circuit comprising a photodetector arranged to sense said registration marks for producing a mark detect signal each time one of said registration marks passes said photodetector, said control circuitry responding to said mark detect signals to provide said stop feed signal and thereby to shift said tube feeder from its powered to its non-powered mode during each bag making cycle.

15. The combination in a packaging machine as set forth in claim 14 wherein said control circuitry includes a photoregistration delay timer arranged to receive said mark detect signals, delay the same, and transmit the same for generation of said stop feed signals, said timer being adapted for manual adjustment of the duration of delay in transmitting said mark detect signals.

16. The combination in a packaging machine as set forth in claim 14 wherein said control circuit includes a feed timer selectively operable as an override device for said photoregistration circuit, said timer being arranged to start on receipt of a cycle start signal and being manually adjustable for setting a time interval greater than the time interval normally expiring prior to receipt of a mark detect signal, and said timer being operable on failure of a mark detect signal to disable said control circuitry.

17. The combination in a packaging machine as set forth in claim 16 wherein said timer is normally set to provide a control circuitry disable signal on failure of two successive mark detect signals, and wherein said control circuitry is operable to reset said timer at the end of each cycle of operation which includes a mark detect signal.

18. The combination in a packaging machine as set forth in claim 1 wherein said control circuitry includes a feed timer operable to start on receipt of said cycle start signal by said control circuitry, and operable to emit a stop feed signal a timed interval thereafter, said timer being adapted for manual adjustment of the duration of said interval of time between feed and stop feed signals.

19. The combination in a packaging machine as set forth in claim 18 wherein said means for providing a tube of packaging material comprises a means providing a web of such material, a folder for folding said web of material into a tube with overlapped side edges, and a longitudinal seam sealer for sealing overlapped side edges of said tube to one another, wherein said web of packaging material is provided with registration marks occurring thereon at regularly spaced intervals along its length, wherein said control circuitry includes a photoregistration circuit comprising a photodetector arranged to sense said registration marks for producing a mark detect signal each time one of said registration marks passes said photodetector, said control circuitry responding to said mark detect signals to provide a stop feed signal and thereby to shift said tube feeder from its powered to its non-powered mode during each bag making cycle, and wherein said control circuitry also includes means for rendering said photoregistration circuit and said feed timer alternatively operable for control of said tube feeder.

20. The combination in a packaging machine as set forth in claim 1 wherein said means for providing a tube of packaging material comprises a means for providing a web of such material, a folder for folding said web of material into a tube with overlapped side edges, and a longitudinal seam sealer for sealing said overlapped side edges of said tube to one another, wherein a code dater is provided for applying indicia to said web of material, and wherein said control circuitry includes a code dater timer adapted for operation by one of said circuitry signals and serving first to delay and thereafter to transmit said signal to said code dater, said timer being adapted for manual adjustment of the duration of delay in transmitting said code dater signal.

21. The combination in a packaging machine as set forth in claim 1 wherein said machine includes a selectively operable plunger for dislodging jammed charges of product for delivery to said tube, wherein said control circuitry includes a plunger timer operable on occurrence of one of said circuitry signals to first delay and to thereafter transmit a plunge signal to said plunger, said timer being adapted for manual adjustment of the delay in transmitting said plunge signal.

22. The combination in a packaging machine as set forth in claim 1 wherein said packaging machine includes a selectively operable air blast device for dislodging charges of product for delivery to said tube, and wherein said control circuitry includes an air blast timer operable on occurrence of one of said circuitry signals first to delay and thereafter to transmit an air blast signal to said device, said timer being adapted for manual adjustment of the duration of delay in transmission of said blast signal.

23. The combination in a packaging machine as set forth in claim 5 wherein said control circuitry includes a side seal overheat timer operable on occurrence of a circuitry signal to monitor cyclical operation of the control circuitry and overheating of the overlapped tube edges adjacent said longitudinal seam sealer, said timer being manually adjustable for setting a time interval longer than the normal time interval of a cycle of operation of said control circuitry and being reset by said control circuitry on occurrence of each stop seal signal indicating completion of a cycle, said longitudinal seam sealer including a selectively operable overheat device for moving said one run of said sealing belt away from the overlapped edge portions of said tube and said timer being connected with said device to operate the same on failure of two or more successive side sealer stop signals.

24. The combination in a packaging machine as set forth in claim 23 wherein said side seal overheat timer is normally set to operate said overheat device on failure of three successive stop seal signals.

25. The combination in a packaging machine as set forth in claim 1 wherein said end sealer is provided with a cut-off knife selectively operable with the end sealer in its operative condition, wherein said control circuitry includes a knife timer and means for starting the same on each occurrence of an operative condition of said end sealer, said knife timer being operable thereafter to emit a cut signal for transmission to said selectively operable knife, and said timer being adapted for manual adjustment of the duration of said cut signal.

26. The combination in a packaging machine as set forth in claim 1 wherein said control circuitry includes means operable to prevent response of said circuitry to a cycle start signal prior to the occurrence of a stop seal signal.

27. The combination in a packaging machine as set forth in claim 1 wherein said control circuitry includes a manual start means operable to disable said control circuitry for response to a cycle start signal prior to manual actuation of said means.

28. The combination in a packaging machine as set forth in claim 1 wherein said control circuitry includes means for effecting a single cycle of operation thereof including feed and seal operations and extending from feed to end seal signals, said means being adapted for manual actuation and self-termination.

29. The combination in a packaging machine as set forth in claim 1 wherein said control circuitry includes at least one timer operable to provide a stop feed signal and adapted for manual adjustment of feed time independently of said end seal timer, said two timers thus being adjustable to control the cyclic operation of said control circuitry independently of the intervals of time between said time spaced cycle start signals.

* * * * *